United States Patent [19]

Rothfuss et al.

[11] Patent Number: 4,971,295

[45] Date of Patent: Nov. 20, 1990

[54] SAFETY-TYPE GAS WASHING SINK HAVING IMPROVED HEAT DISSIPATION PROPERTIES

[75] Inventors: Hans Rothfuss, Taunusstein; Raimund Brückner, Engenhahn-Niedernhausen; Manfred Winkelmann, Krefeld, all of Fed. Rep. of Germany

[73] Assignee: Didier-Werke AG, Wiesbaden, Fed. Rep. of Germany

[21] Appl. No.: 413,672

[22] Filed: Sep. 28, 1989

[30] Foreign Application Priority Data

Oct. 1, 1988 [DE] Fed. Rep. of Germany ..... 3833503

[51] Int. Cl.[5] ..... C21C 5/48

[52] U.S. Cl. ..... 266/220; 266/270

[58] Field of Search ..... 266/217, 220, 270; 222/603

[56] References Cited

U.S. PATENT DOCUMENTS

| | | | |
|---|---|---|---|
| 4,589,635 | 5/1986 | Reichard et al. | 266/220 |
| 4,721,287 | 1/1988 | Winkelman | 266/270 |
| 4,779,849 | 10/1988 | Rothfuss et al. | 266/270 |

FOREIGN PATENT DOCUMENTS

| | | |
|---|---|---|
| 105868 | 4/1984 | European Pat. Off. . |
| 137961 | 4/1985 | European Pat. Off. . |
| 181853 | 5/1986 | European Pat. Off. . |
| 1608036 | 12/1970 | Fed. Rep. of Germany . |
| 3240097 | 5/1984 | Fed. Rep. of Germany . |
| 3316459 | 11/1984 | Fed. Rep. of Germany . |
| 3538498 | 5/1987 | Fed. Rep. of Germany . |
| 3623609 | 1/1988 | Fed. Rep. of Germany . |
| 3716920 | 12/1988 | Fed. Rep. of Germany . |
| WO88/06191 | 8/1988 | World Int. Prop. O. . |

*Primary Examiner*—S. Kastler

*Attorney, Agent, or Firm*—Wenderoth, Lind & Ponack

[57] ABSTRACT

A safety-type gas washing sink for use in introducing gas through a metallurgical vessel and molten metal therein includes a refractory wearable brick portion defining a first sink end to be exposed to the molten metal and becoming worn during use, such wearable brick portion having therethrough gas flow paths for the passage of gas into the molten metal, and a refractory safety brick portion defining a second sink end to be directed away from the molten metal and through which the gas can be delivered to the gas flow paths in the wearable sink portion. The safety brick portion has a higher thermal conductivity than the wearable brick portion, and the gas flow paths continue into the safety brick portion. Thus, any molten metal that breaks through the wearable brick portion to the safety brick portion will be caused to solidify at the safety brick portion due to rapid dissipation of heat thereby.

15 Claims, 3 Drawing Sheets

SAFETY-TYPE GAS WASHING SINK HAVING IMPROVED HEAT DISSIPATION PROPERTIES

BACKGROUND OF THE INVENTION

The present invention relates to an improved safety-type gas washing sink for use in introducing gas through a metallurgical vessel into molten metal therein, the sink being of the type including a refractory wearable brick portion defining the first sink end to be exposed to the molten metal and that becomes worn during use, such wearable brick portion having therethrough gas flow paths for the passage therethrough of gas into the molten metal, and a refractory safety brick portion defining a second sink end to be directed away from the molten metal and through which the gas is delivered to the gas flow paths in the wearable sink portion.

This type of gas washing sink is intended to operate in a manner such that, upon the wearable brick portion becoming eroded or worn during use, the safety brick portion prevents a molten metal break through the sink by causing any such molten metal that reaches the safety brick portion to freeze or solidify. A gas washing sink of this type is disclosed in European EP No. 0 105 868. In such known arrangement the wearable brick portion is cemented or mortared into a recess in the safety brick portion, and a gas delivery pipe provided within the safety brick portion has a spiral shape. In the event of molten metal breaking through to the safety brick portion, the molten metal will enter such pipe and is intended to freeze therein. However, since the pipe is arranged within the safety brick portion, and such safety brick portion has a relatively low thermal conductivity, it is not entirely guaranteed that the molten metal will freeze within the pipe. As a result, prevention of molten metal breaking through the entire sink is not ensured by this known device.

A safety-type gas washing sink without a refractory safety brick portion is disclosed in European EP No. 0 181 853. The safety component of this known arrangement includes a metal core provided with a metal spiral member arranged in a gas delivery pipe beneath a wearable brick sink. In the event of molten metal breaking through the wearable brick sink, it is intended that such molten metal will freeze or solidify when contacting the metal core and metal spiral. However, in the event that the metal core and metal spiral themselves have reached a relatively high temperature, it cannot be guaranteed that the metal will freeze thereat. As a result, since the molten metal already will have penetrated into the gas delivery pipe in the event of a molten metal breakthrough, if the molten metal does not solidify at the metal core and metal spiral, then a complete breakthrough will occur. Furthermore, this known arrangement has the additional disadvantage that the metal core and metal spiral must be of substantial size and therefore occupy a substantial amount of space.

SUMMARY OF THE INVENTION

With the above discussion in mind, it is an object of the present invention to provide a safety-type gas washing sink that has improved heat dissipation properties so that it is possible to avoid the above and other prior art disadvantages.

It is a more specific object of the present invention to provide such a safety-type gas washing sink having improved heat dissipation properties whereby it is possible to ensure that, in the event of molten metal breaking through a wearable brick portion, such molten metal definitely solidifies or freezes before it reaches a gas inlet connection.

The above objects are achieved in accordance with the present invention by the provision of an improved safety-type gas washing sink for use in introducing gas through a metallurgical vessel into molten metal therein, the sink being of the type including a refractory wearable brick portion defining a first sink end to be exposed to the molten metal and that becomes worn during use, the wearable brick portion having therethrough gas flow paths for the passage therethrough of gas into the molten metal, and a refractory safety brick portion defining a second sink end to be directed away from the molten metal and through which the gas can be delivered to the gas flow paths in the wearable sink portion. The improvements in accordance with the present invention comprise the features that the safety brick portion has a higher thermal conductivity than does the wearable brick portion, and that the gas flow paths continue from the wearable brick portion into the safety brick portion.

The fact that the safety brick portion has a relatively high thermal conductivity makes it possible for the safety brick portion to very rapidly dissipate or withdraw heat in the event that the molten metal breaks through the wearable brick portion. As a result, any molten metal reaching the safety brick portion rapidly will have the heat withdrawn therefrom so that such molten metal will freeze or solidify. The fact that the gas flow paths continue from the wearable brick portion into the safety brick portion provides the advantage that any molten metal that breaks through the wearable brick portion or passes into the gas flow paths will be distributed or directed into the gas flow paths in the safety brick portion. Any such molten metal therefore will occur in the safety brick portion only in the form of very fine thread-like portions, and the heat thereof quickly and rapidly will be withdrawn or dissipated due to the high thermal conductivity of the safety brick portion. This will ensure rapid freezing or solidification of any such molten metal.

In accordance with these features of the present invention it is possible to reliably ensure that any molten metal positively will freeze or solidify within the confines of the safety brick portion without any possibility of reaching a gas inlet pipe or connection that may be connected to the safety brick portion. A further advantageous feature of the present invention is that the construction thereof is quite simple in spite of the substantially high reliability of the present invention compared with known gas washing sinks of this type.

In accordance with a preferred feature of the present invention, the increased thermal conductivity of the safety brick portion is achieved by means of heat conductive particles within the safety brick portion, for example embedded within the refractory material thereof. Such heat conductive particles may be, for example, metal particles, for example copper chips, SiC particles or graphite flakes, for example preferably oriented in the refractory material of the safety brick portion in such a manner that the preferred direction of heat dissipation is directed outwardly.

In accordance with a further feature and embodiment of the present invention, the wearable brick portion and the safety brick portion are formed integrally as a single element from the same refractory material. In such case, that portion of such single refractory element that forms the safety brick portion is produced in a manner to have the required higher thermal conductivity, for example by embedding in the refractory material thereof the above discussed high thermal conductivity particles.

In accordance with a further feature and embodiment of the present invention, it is possible to insulate the safety brick portion from the wearable brick portion, for example by means of an interface member positioned therebetween and having a lower thermal conductivity then the wearable brick portion. Heat transfer from the wearable brick portion to the safety brick portion thus is reduced so that the safety brick portion remains colder than the wearable brick portion. This is a favorable advantage and feature for ensuring freezing or solidification of any molten metal that breaks through the wearable brick portion and the interface member. The interface member can be formed, for example, of a refractory fiber material.

In accordance with a further feature of the present invention, a meltable body may be embedded within the wearable brick portion and be abutted by a valve rod that extends through the sink into abutment therewith. During normal operation, abutment of the valve rod maintains in an open position a valve that controls the amount of gas supplied to the sink. This improves the reliability of operation of the gas washing sink. When the wearable brick portion is worn away to a predetermined extent, the temperature of the meltable body increases and it melts. This causes the valve rod to relatively close or restrict the valve, thereby resulting in a reduced gas flow to the sink. This reduced, i.e. completely or partially, gas flow, or a resultant increased gas pressure, can be detected or evaluated to indicate a condition involving potential molten metal breakthrough.

BRIEF DESCRIPTION OF THE DRAWINGS

Other objects, features and advantages of the present invention will be apparent from the following detailed description of preferred embodiments thereof, taken with the accompanying drawings, wherein.

DETAILED DESCRIPTION OF THE INVENTION

Figure 1:
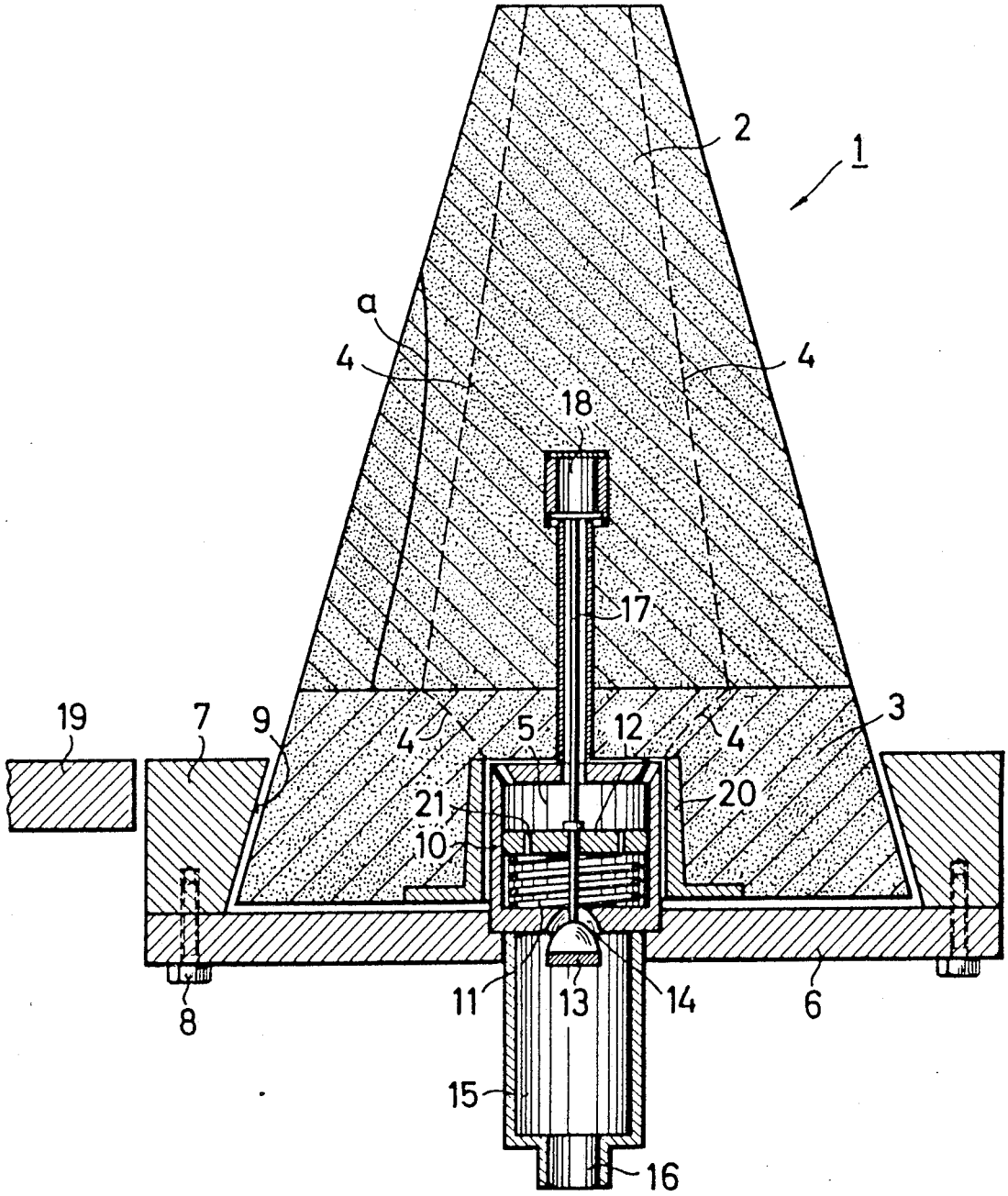
FIG. 1 is a longitudinal cross-sectional view through one embodiment of an improved safety-type gas washing sink according to the present invention.

In FIG. 1 there is illustrated a safety-type gas washing sink 1 to be used for introducing gas through a metallurgical vessel into molten metal therein. The metallurgical vessel itself is not shown, except for an outer metal jacket 19 thereof. One skilled in the art would understand the manner of mounting such a gas washing sink in a metallurgical vessel. Safety-type gas washing sink 1 includes a refractory wearable brick portion 2 defining an inner or first sink end to be exposed to molten metal and that becomes worn during use. Gas flow paths 4 extend through wearable brick portion 2 to enable the passage therethrough of gas into molten metal within the metallurgical vessel. Gas flow paths 4 may be defined or provided in any conventional manner that would be understood by one skilled in the art. In the illustrated arrangement gas flow paths 4 are in the form of labyrinth rinsers defining a plurality of gas flow paths. Again however, the gas flow paths could be formed in any other known manner, for example as capillary rinsers or disc rinsers.

The safety-type gas washing sink 1 also includes a safety-brick portion 3 that is intended to operate in a manner such that, in the event of molten metal breaking through wearable brick portion 2, such molten metal is frozen or solidified before it breaks entirely through the sink, to thereby avoid a serious operational and safety hazard. In the embodiment of FIG. 1 it is contemplated that wearable brick portion 2 and safety brick portion 3 are formed or manufactured integrally as a single element from the same refractory material, for example from a hydraulically or chemically binding refractory ceramic compound, as would be understood by one skilled in the art. The two brick portions 2, 3 thus merge integrally in a seamless manner.

In accordance with the present invention, the safety brick portion 3 has a higher thermal conductivity than the wearable brick portion 2. This may be achieved, for example in the above discussed integral manufacture of the two brick portions, by providing that the safety brick portion 3 has therein heat conductive particles as would be understood by one skilled in the art. Such particles may be of metal, for example of copper chips embedded in the refractory material of the safety brick portion. As a result of the higher thermal conductivity of safety brick portion 3, in the event that any molten metal breaks through the wearable brick portion 2, for example as indicated schematically at a in FIG. 1, as soon as such molten metal contacts the safety brick portion 3, the heat from such molten metal rapidly will be withdrawn and dissipated. As a result, the molten metal will rapidly and surely solidify or freeze.

In accordance with a further feature of the present invention, the gas flow paths 4 continue from the wearable brick portion 2 into the safety brick portion 3. As a result, if molten metal breakthrough occurs in the area of gas flow paths 4, or if molten metal breaks into such gas flow paths, then the molten metal will pass through paths 4 within safety brick portion 3, and such molten metal in safety brick portion 3 will be in the form of very small elements, for example thread-like elements. The safety brick portion 3 very rapidly will withdraw or dissipate heat from such molten metal portions such that these portions very rapidly will freeze or solidify.

In view of the above features of the present invention, any molten metal that breaks through the wearable brick portion 2 very rapidly and surely will be solidified without the possibility of reaching a gas inlet connection or pipe of the gas washing sink.

The embodiment of FIG. 1 illustrates additional features that may be incorporated into the present invention. Particularly, safety brick portion 3 has therein a gas distribution chamber 5 extending inwardly from the second sink end, i.e. the lower end shown in FIG. 1, and terminating within safety brick portion 3. The gas flow paths 4 extend through that part of safety brick portion 3 from gas distribution chamber 5 to wearable brick portion 2. A closure member 6 is removably attachable to safety brick portion 3 to close gas distribution chamber 5. In the illustrated arrangement, closure member 6 is bolted to a centering ring 7, for example by bolts 8. Centering ring 7 has an inner surface 9 complementary to the exterior surface, for example conical, of safety brick portion 3. A cylinder 10 is connected to closure member 6 and extends into gas distribution chamber 5. Cylinder 10 has at an inner end thereof orifices that communicate gas distribution chamber 5 with gas flow paths 4. Cylinder 10 has at an outer end thereof a valve seat 14. Slidable within cylinder 10 is a piston 12 having therethrough orifices 21. A valve rod 17 is connected to a valve or valve member 13 that regulates the amount of gas supplied into gas distribution chamber 5 from a pipe section 15 connected to closure member 6 and/or cylinder 10. A gas inlet connection 16 opens into pipe section 15. Embedded within wearable brick portion 2 is a meltable body 18 capable of melting in response to a temperature rise indicate of a predetermined extent of wear of the wearable brick portion 2. Valve rod 17 abuts meltable body 18 and maintains piston 12 in a position such that valve 13 fully opens valve seat 14, i.e. against the force of a compression spring 11. When the meltable body 18 melts, spring 11 forces piston 12 and valve rod 17 further inwardly to an extent to partially or fully restrict the passage through valve seat 14. This results in a reduced gas flow and/or increased gas pressure that can be detected to indicate the relative extent of wear of the wearable brick portion 2 and/or an impending potential molten metal breakthrough and/or the need to replace the sink. The specific structure of the meltable body 18 acted upon by the valve rod 17 in and of itself does not form the present invention, but rather is the invention of an application concurrently filed herewith and entitled GAS WASHING SINK, APPARATUS AND ASSEMBLY FOR INTRODUCING GAS INTO A METALLURGICAL VESSEL, assigned to the assignee of the present application (Ref: 59/PA3810), the disclosure of which is incorporated herein by reference.

A sleeve 20 fits between cylinder 10 and safety brick portion 3 to define a tight seal therebetween. In FIG. 1 this fit is illustrated with a gap therebetween solely for ease of illustration. In actual use, sleeve 20 is compressed to define a seal between cylinder 10 and safety brick portion 3.

Furthermore, it is contemplated that in accordance with a further advantageous feature of the present invention, the safety brick portion 3 may be thermally connected to centering ring 7 and/or therethrough to outer metal jacket 19 of the metallurgical vessel. This further would facilitate rapid heat dissipation from any molten metal breaking through to safety brick portion 3. In FIG. 1, elements 3, 7, 19 are shown with gaps therebetween, but such gaps could be eliminated if necessary to provide the above discussed thermal connection.

Due to the very rapid solidification of any molten metal breaking through to safety brick portion 3, such molten metal never reaches gas distribution chamber 5 and closure member 6. When it is necessary to replace the sink 1, the sink 1 is removed along with closure member 6 from the metallurgical vessel. After removal of the centering ring 7, closure member 6 as well as cylinder 10 and valve rod 17 are withdrawn from the worn sink and readily may be assembled to a new sink to be inserted into the metallurgical vessel.

Figure 2:
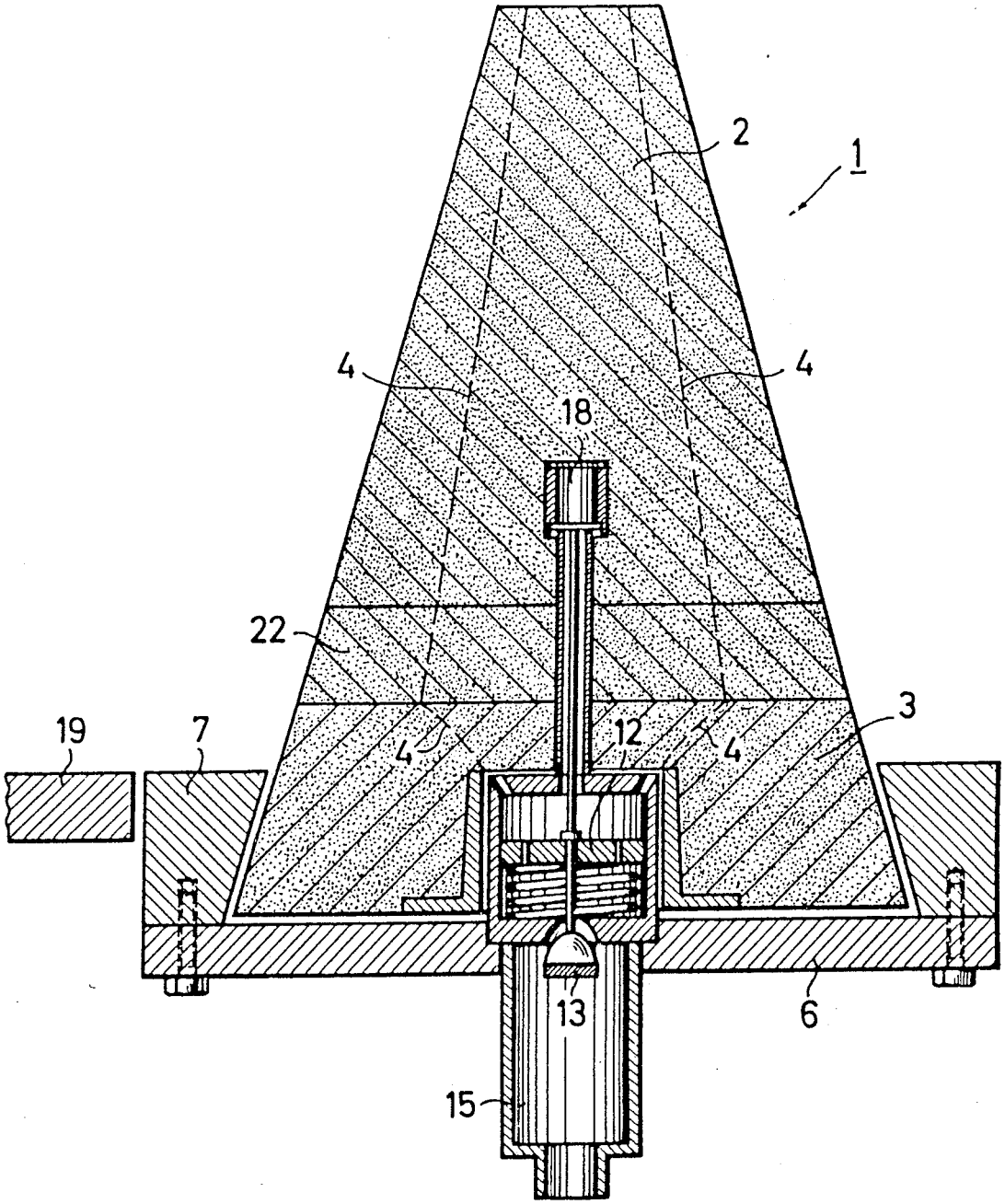
FIG. 2 is a similar view of another embodiment thereof.

The embodiment of FIG. 2 is similar to the embodiment of FIG. 1, with the exception that there is provided an interface member 22 positioned between wearable brick portion 2 and safety brick portion 3 to thermally insulate the safety brick portion 3. Interface member 22 has a lower thermal conductivity than wearable brick portion 2 and may be made of any suitable material having such properties as would be understood by one skilled in the art, for example refractory ceramic fiber material. Such material can be manufactured or formed integrally with wearable brick portion 2 and safety brick portion 3 in a manner as clearly would be understood by one skilled in the art. Interface member 22 insulates safety brick portion 3 such that it is heated only slightly during use, thereby even further improving rapid heat dissipation of heat from any molten metal that breaks through to the safety brick portion.

Figure 3:
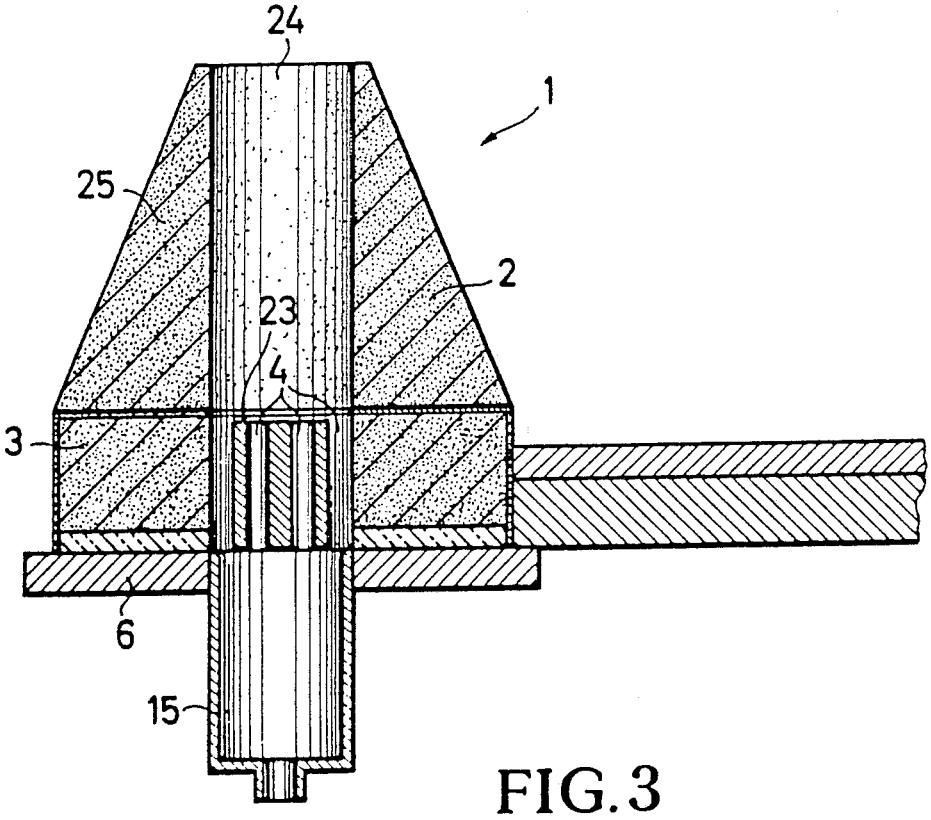
FIG. 3 also is a similar view of yet another embodiment thereof.

In the embodiment of FIG. 3, the wearable brick portion 2 and the safety brick portion 3 are formed as separate components, in a manner as would be understood by one skilled in the art, for example as disclosed in U.S. Pat. No. 4,711,432, the disclosure of which hereby is incorporated by reference. In the illustrated arrangement of FIG. 3, safety brick portion 3 has a shell or jacket, for example of metal. Wearable brick portion 2 includes an outer, relatively gas impermeable refractory portion 25 and an inner gas permeable refractory portion 24. Flow paths 4 are in the form of capillaries that extend from pipe section 15 of closure member 6 to an intermediate space or gap 23. Thus, the gas flow paths extend into the safety brick portion 3. Also, the safety brick portion 3 has a higher thermal conductivity than does wearable brick portion 2. The embodiment of FIG. 3 operates in the above described manner to ensure that any molten metal breaking through wearable brick portion 2 rapidly is solidified, thus preventing molten metal from reaching pipe section 15 and/or closure member 6. In the embodiment of FIG. 3, the safety brick portion 3 can be reused by detachment from a worn wearable brick portion 2 and connection or assembly with a new wearable brick portion 2. This would be achieved in a manner understood by those skilled in the art from a consideration of the present disclosure.

Although the present invention has been described and illustrated with respect to preferred features thereof, it is to be understood that various changes and modifications may be made to the specifically described and illustrated features without departing from the scope of the present invention.

We claim:

1. In a safety-type gas washing sink for use in introducing gas through a metallurgical vessel into molten metal therein, said sink including a refractory wearable brick portion formed of refractory material and defining a first sink end to be exposed to the molten metal and that becomes worn during use, said wearable brick portion having therethrough gas flow paths for the passage therethrough of gas into the molten metal, and a refractory safety brick portion formed of refractory material and defining a second sink end to be directed away from the molten metal, said gas flow paths continuing into said safety brick portions so that the gas can be delivered to said gas flow paths in said wearable sink portion, the improvement comprising means for ensuring that any molten metal breaking through said wearable brick portion will be caused to solidify at said safety brick portion and will be prevented from breaking through said safety brick portion, said means comprising:

said refractory material of said safety brick portion having embedded therein particles of a material having a conductivity sufficient to provide that said safety brick portion has a higher thermal conductivity than said wearable brick portion, said particles being oriented in said refractory material of said safety brick portion in a manner such that heat dissipation thereby will be directed outwardly of said safety brick portion in directions toward a component to be positioned at an outer portion of the metallurgical vessel, thereby enhancing heat dissipation in said directions; and whereby any molten metal passing through said gas flow paths to said safety brick portion will be caused to solidify at said safety brick portion due to rapid dissipation of heat thereby.

2. The improvement claimed in claim 1, wherein said particles are metal particles.

3. The improvement claimed in claim 2, wherein said metal particles comprise copper chips embedded in said refractory material of said safety brick portion.

4. The improvement claimed in claim 1, wherein said wearable brick portion and said safety brick portion are formed integrally as a single element from the same refractory material.

5. The improvement claimed in claim 1, in combination with an outer metal jacket of the bottom wall of the metallurgical vessel, said outer metal jacket being said component, said safety brick portion being thermally connected to said outer metal jacket, thereby further improving dissipation of heat from said safety brick portion.

6. The improvement claimed in claim 1, further comprising an interface member positioned between said wearable brick portion and said safety brick portion and having a lower thermal conductivity than said wearable brick portion.

7. The improvement claimed in claim 6, wherein said interface member comprises refractory fiber material.

8. The improvement claimed in claim 6, wherein said gas flow paths pass through said interface member.

9. The improvement claimed in claim 1, wherein said safety brick portion has therein a gas distribution chamber extending inwardly from said second sink end and terminating within said safety brick portion, and said gas flow paths extend through said safety brick portion from said gas distribution chamber to said wearable brick portion.

10. The improvement claimed in claim 9, further comprising a closure member removably attachable to said safety brick portion to close said gas distribution chamber.

11. The improvement claimed in claim 10, further comprising gas inlet means connected to said closure member for introducing gas therethrough and into said gas distribution chamber.

12. The improvement claimed in claim 1, further comprising a meltable body embedded in said wearable brick portion and capable of melting in response to a temperature rise indicative of a predetermined extent of wear of said first sink end.

13. The improvement claimed in claim 12, further comprising a valve connected to a gas inlet and mounted in said safety brick portion, and a valve rod connected to said valve and extending through said sink into abutment with said meltable body to thereby maintain said valve in an open position thereof, whereby when said meltable body melts said valve rod is allowed to move such that said valve is in a restricted position thereof.

14. The improvement claimed in claim 13, further comprising a closure member removably attachable to said safety brick portion, said valve and valve rod being connected to said closure member, such that upon removal of said closure member from said safety brick portion said valve rod also is removed from said sink.

15. The improvement claimed in claim 1, wherein said wearable brick portion and said safety brick portion are separate components that are removably connectable.

* * * * *